United States Patent [19]

Hogenkamp et al.

[11] Patent Number: 4,897,983

[45] Date of Patent: Feb. 6, 1990

[54] WRAPPER FOR TUBULAR PRODUCTS, ESPECIALLY CHOCOLATE BARS AND METHOD OF MANUFACTURING IT

[75] Inventors: Wilhelm Hogenkamp, Hanover; Gert Wostbrock, Garbsen, both of Fed. Rep. of Germany

[73] Assignee: Otto Hänsel GmbH, Hanover, Fed. Rep. of Germany

[21] Appl. No.: 205,073

[22] Filed: Jun. 10, 1988

[30] Foreign Application Priority Data

Jun. 12, 1987 [DE] Fed. Rep. of Germany ..... 3719610

[51] Int. Cl.[4] ..... B65B 7/08; B65B 11/02

[52] U.S. Cl. ..... 53/461; 53/466; 53/491; 53/479; 53/481

[58] Field of Search ..... 53/461, 466, 479, 481, 53/482, 491, 229, 379

[56] References Cited

U.S. PATENT DOCUMENTS

| | | | |
|---|---|---|---|
| 2,070,736 | 2/1937 | Johnson | 53/466 |
| 2,449,334 | 9/1948 | Smith | 53/461 |
| 2,651,578 | 9/1953 | Bodolay | 53/482 X |
| 4,724,997 | 2/1988 | Hogenkamp | 53/462 |
| 4,785,609 | 11/1988 | Widman | 53/482 X |

FOREIGN PATENT DOCUMENTS

| | | | |
|---|---|---|---|
| 327555 | 3/1958 | Switzerland | 53/229 |

*Primary Examiner*—John Sipos

*Attorney, Agent, or Firm*—Max Fogiel

[57] ABSTRACT

A wrapper for tabular products, especially chocolate bars. The wrapper consists of a one-piece blank wrapped asymmetrically around the bar to create a facing and of a tube of wrapping material established by a longitudinal sealing seam adjacent to one side of the bar and closed at the ends of the bar by a bellows. The bellows encompasses the longitudinal sealing seam as part of the tube of wrapping material and is wrapped around onto the lower surface of the bar to create an inner flap. The facing covers up areas of the bellows and is secured to the portion of the tube of wrapping material adjacent to the lower surface of the bar. The blank (7) is rectangular. The facing (25) is created by folding in the inner flaps (24) in such a way that both the facing and the inner flap are free of any part of the longitudinal sealing seam (11). The bellows is bridged by a transverse sealing seam (21) located in one area of the bellows that is wrapped against the lower surface (3) of the bar (1) and covered by the facing.

6 Claims, 4 Drawing Sheets

Figure 1:
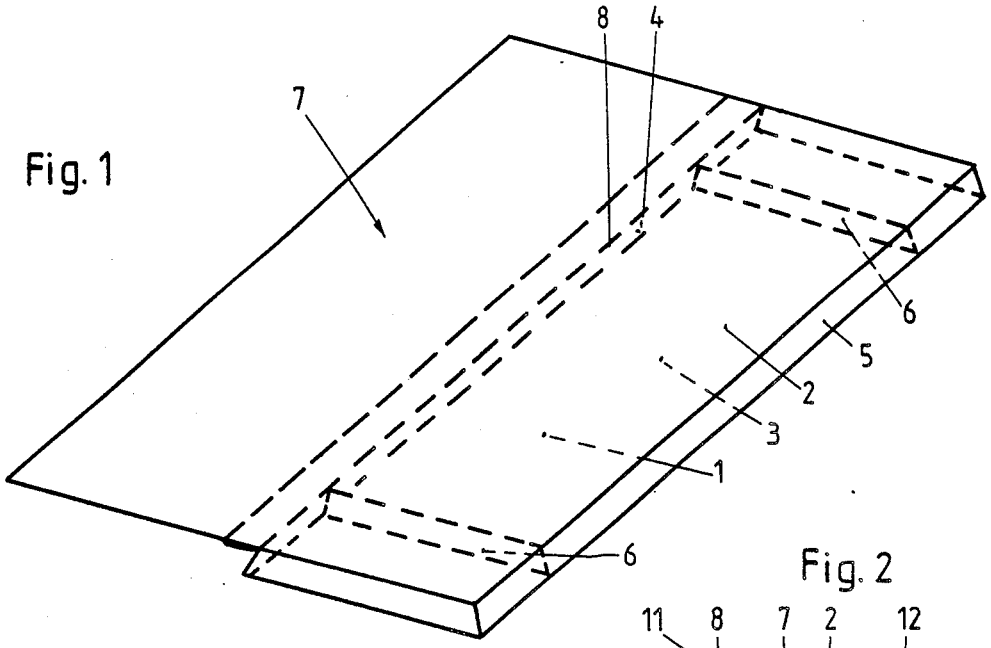

WRAPPER FOR TUBULAR PRODUCTS, ESPECIALLY CHOCOLATE BARS AND METHOD OF MANUFACTURING IT

The invention concerns a wrapper for tabular products, especially chocolate bars, that consists of a one-piece blank wrapped asymmetrically around the bar to create a facing and a tube of wrapping material established by a longitudinal sealing seam adjacent to one side of the bar and closed at the ends of the bar by a bellows that encompasses the longitudinal sealing seam as part of the tube of wrapping material and is wrapped around onto the lower surface of the bar to create an inner flap, whereby the facing covers up areas of the bellows and is secured to the portion of the tube of wrapping material adjacent to the lower surface of the bar.

German OS No. 3 444 950 same as U.S. Pat. No. 4,724,997 discloses a wrapper of this type consisting of a rectangular blank of heat-sealing material trimmed to match the dimensions of the bar. The longitudinal sealing seam in the tube of wrapping material rests against the side of the bar. At least some of the material in the vicinity of the longitudinal sealing seam will accordingly arrive next to the bar adjacent to the longitudinal seam when the projecting area of the blank is wrapped down onto the lower surface of the bar or of the tube of wrapping material. Since the blank is a sheet of material that is notched at the corners adjacent to the facing, no inner flap will form at that point and the facing is also not part of the tube of wrapping material but extends out of the wrapper like a collar while the wrapper is being created and does not get wrapped down against the lower surface of the bar and secured there until the packaging process is complete. Establishing the notches in the blank demands an additional manufacturing step even though it is accordingly also possible of course to provide the facing with the desired slightly trapezoidal shape that would otherwise be attainable only with an inner flap. In this case as well, however, the wrapper will already be provided with the conventional appearance of an envelope. There is no problem involved in obtaining either a bellows at the ends or a transverse seal because the notches in the blank are unrelated to the portion of the blank that constitutes the facing and accordingly do not affect it deleteriously.

Both European patent No. 161 214 and German No. OS 3 605 783 also disclose a wrapper and a method of manufacturing it that employ a single, single-piece in other words, rectangular, and multilayer blank that can either be heat-sealed or not. One layer of the multilayer blank can be aluminum foil. The blank is wrapped asymmetrically around the bar, leaving part of the blank projecting. A tube of wrapping material is created by establishing a longitudinal sealing seam along one side of the bar by means of sealing the free margin of the blank against the lower surface of the projecting area of the blank. The areas of the tube at the ends of the bar are then folded in and wrapped down against the lower surface of the bar. The facing is then produced from the projecting area by wrapping it against the lower surface of the bar in such a way that the folded-in ends are partly covered. It is practical to employ only a single-piece blank, in which case the packaged bar assumes the classical appearance of an envelope The longitudinal sealing seam is applied adjacent to the edge that demarcates the lower surface of the bar from the side. The longitudinal sealing seam is part of the projecting area of the blank or of the facing and not of the tube of wrapping material When the two ends are folded in, the projecting area is left outside with the longitudinal sealing seam and is accordingly not part of the actual tube, and the reinforcement of the blank provided by the seam actually results in the risk of at least making it more difficult if not impossible to fold the ends in cleanly and with well-defined creases, especially when the ends of the tube are positioned only by means of thrusters. The tightness of the package in that region is problematical. It is also desirable to be able to seal the bellows at the sides before wrapping the blank around, although how this could be done and how the problems that derive from the position of the longitudinal sealing seam and the projecting area of the blank or facing could be eliminated is still moot.

Swiss patent No. 327 555 discloses a method and a wrapper for tabular products, especially chocolate bars that employs a rectangular blank of heat-sealing material or of a material with a heat-sealing layer. The blank is initially wrapped in the shape of a U around the bar in such a way that the material that the blank is made out of is symmetrically distributed in relation to one side of the bar and both legs of the U rest against the two major surfaces of the bar. The two outwardly extending areas of the blank are then folded up parallel to the other side of the bar and longitudinally secured together by a hot-sealing seam. The two edges of the blank, secured together in this way, are folded over onto the upper surface of the bar in such a way that the edges intersect the surface. A tube of wrapping material is accordingly made out of the blank, its outwardly extending ends are folded in, and the bellows is wrapped rectangularly around the bar and left standing out. In this state the material is heat-sealed transversely and the folded-in ends are finally folded down against the lower surface of the bar.

The object of the present invention is to provide both a wrapper and a method of manufacturing it wherein the blank of heat-sealing material is not notched and that retains the appearance of an envelope while ensuring the tightness of the wrapper, especially by making transverse sealing possible.

The wrapper for tabular products of the type initially described is characterized in accordance with the invention in that the blank is rectangular, in that the facing is created by folding in the inner flaps in such a way that both the facing and the inner flap are free of any part of the longitudinal sealing seam, and in that the bellows is bridged by a transverse sealing seam located in one area of the bellows that is wrapped against the lower surface of the bar and covered by the facing. A longitudinal sealing seam will be effective not lonely in relation to notched blanks but also to rectangular blanks because it is involved in the vicinity of the tube of wrapping material and accordingly reinforces one side of the tube in the projecting area, which is absolutely necessary to obtain creases in the bellows.

It is, however, only possible to obtain a bellows and a transverse sealing seam without impediment from attached parts of the blank when the projecting part of the blank is wrapped around onto the lower surface of the bar before the bellows is established, a procedure that is usually possible only much later in the manufacturing process. The bellows, however, then becomes possible to establish with well-defined and reproducible creases. A well-defined bellows, again, is a prerequisite to establishment of a transverse sealing seam in a state such that tightness can be obtained from that point all the way to the corners. The transverse sealing seam can accordingly extend and bridge over the total width of the bellows. This approach also counteracts in a practical way the formation of fluting that might detrimentally affect the tightness of the wrapper. Since the transverse sealing does not include the part of the blank that is wrapped down because the heat-sealing layer rests at that point against a layer of the bellows that is not heat-sealing, the projecting portion of the blank can be opened again and inner flap created to establish the facing, which can then finally be folded over the lower surface once the bellows have been wrapped down.

The method in accordance with the invention is characterized in that, with a rectangular blank as a point of departure, once the longitudinal sealing seam has been established, the part of the blank that projects beyond the longitudinal sealing seam is wrapped against the lower surface of the bar in such a way that the projecting part also rests against the bar in the capacity of part of the tube of wrapping material, in that, once the bellows has been established, the tube of wrapping material that extends beyond the end of the bar, including the longitudinal sealing seam, is sealed tight in that state at both ends by a transverse seal that also extends over the projecting area, and in that the tube of wrapping material is opened subsequent to transverse sealing by pivoting out the projecting area in order to fold the areas of the tube that include the transverse seal and the bellows, and not until then the projecting area, while establishing the inner flaps back against the lower surface again in the form of a facing and securing it there. Establishing the longitudinal sealing seam at a different point, specifically adjacent to the side of the bar between the upper surface and one side of the bar results in several advantages. The longitudinal sealing seam is remote from the facing in the vicinity of the bellows and does not impede establishment of the inner flap on the facing. Furthermore, the longitudinal sealing seam does not impede establishment of the bellows or the transverse seal any more than it does that of the facing. The procedure, however, does allow simultaneously maintaining the projecting area of the blank as part of the tube of wrapping material against the lower surface of the bar while the transverse seal is being established. This approach exploits the situation that transverse sealing will only ensure a tight bond between the different areas of material where the two heat-sealing layers face each other and accordingly come into contact. This happens, in conjunction with the well-defined bellows, in all areas where the wrapper must be tightly sealed in consequence of the transverse seal. The only exception is in the vicinity of the projecting area of the blank, where the heat-sealing layer faces the outside of the blank, which does not have a heat-sealing layer. Thus, the projecting area is not, in spite of participating in the transverse sealing seam, secured to the bellows area but can be opened and closed again by being pivoted out. Another advantage is that, during the transverse sealing process, all the material in the appropriate areas can be covered with no projecting area of the blank or facing impeding the transverse seal. The transverse seal can accordingly be established more easily and reliably than at the state of the art. The wrapper, however, will still have the appearance of an envelope, so attractive to consumers of chocolate, and not look like a tubular bag.

The tube of wrapping material that extends from the ends of the bar can, with the exception of the projecting area of the blank, be folded in well defined and as intended while the bellows is being established and the areas of the tube of wrapping material simultaneously positioned in the plane defined by the lower surface of the bar such that the transverse seal can be established in that position. The projecting area of the blank, including those parts that will later constitute the inner flap, will simultaneously be situated in a plane wherein the other areas of the bellows arrive. The transverse seal is easy to establish in that plane, securely sealing the wrapper.

The inner flap can be wrapped around while the transversely sealed areas of the tube of wrapping material are being folded under, between opening the projecting part of the blank and refolding the facing. The longitudinal sealing seam does not impede the establishment of the inner flap, which can be established in a practical way in that the facing has a slightly trapezoidal shape that still covers the essential areas on the lower surface of the bar. A crease that occurs when the bellows is established can be folded 180° while the projecting area of the blank is being opened and the facing is being refolded, establishing the inner flap, which is adjacent to the crease. This facilitates folding in and creates well-defined relationships.

Figure 2:
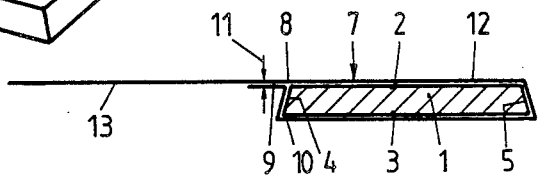
Figure 3:
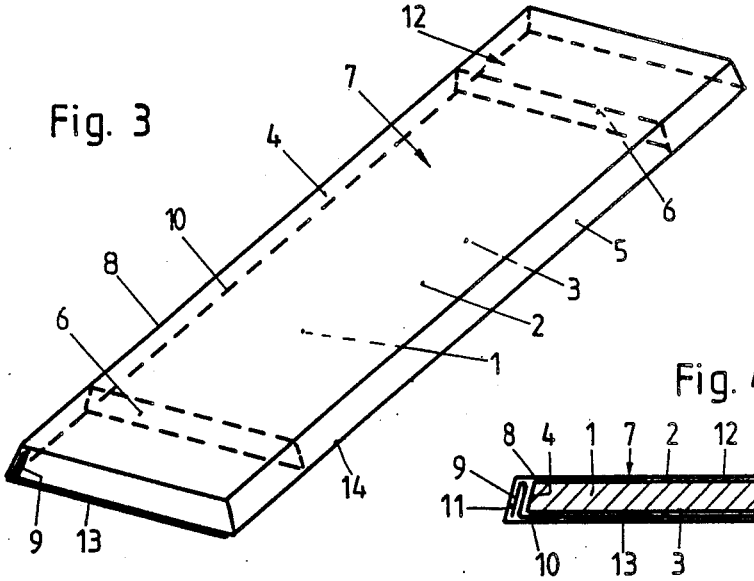
Figure 4:
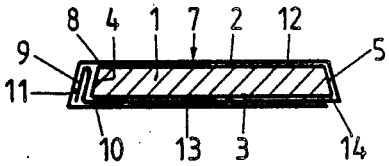
Figure 5:
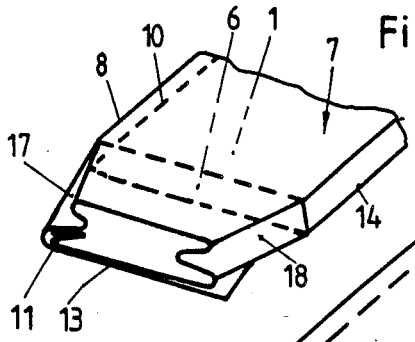
Figure 6:
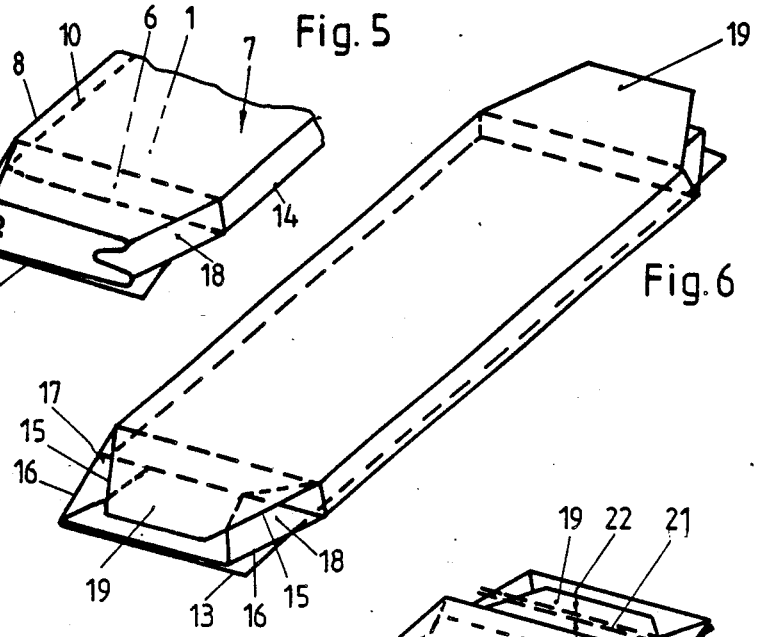
Figure 7:
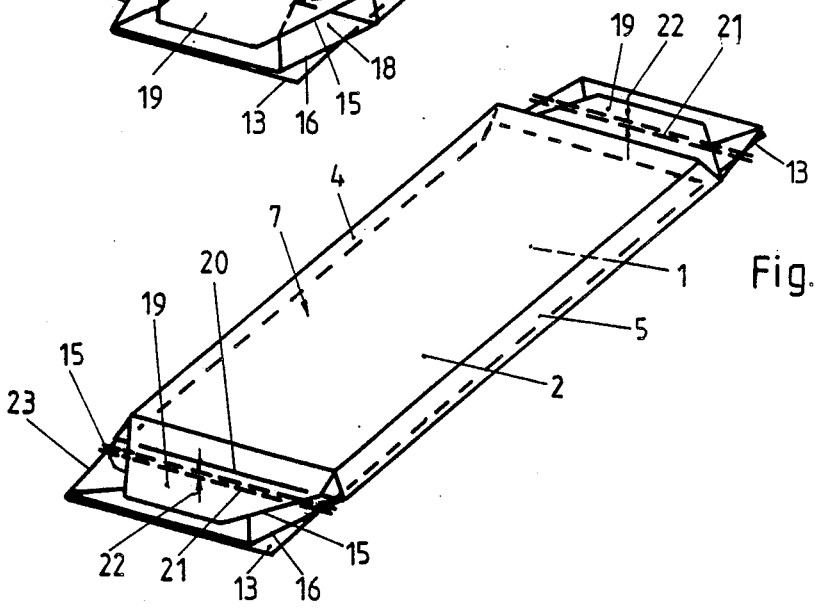
Figure 8:
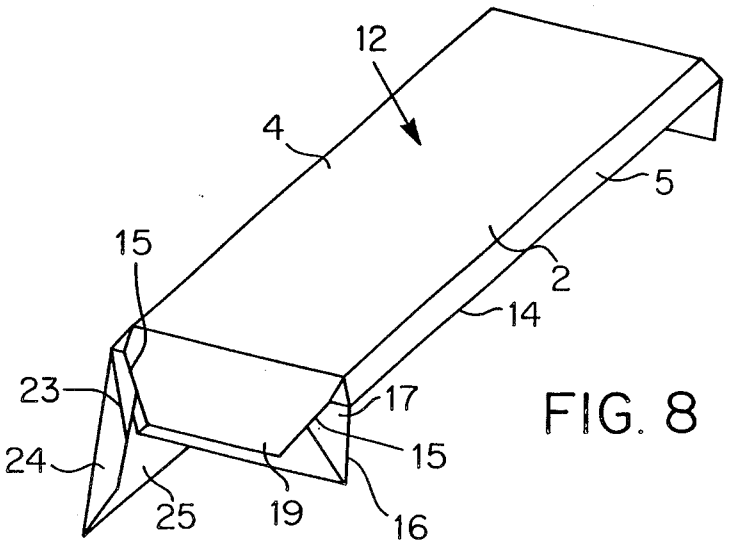
Figure 9:
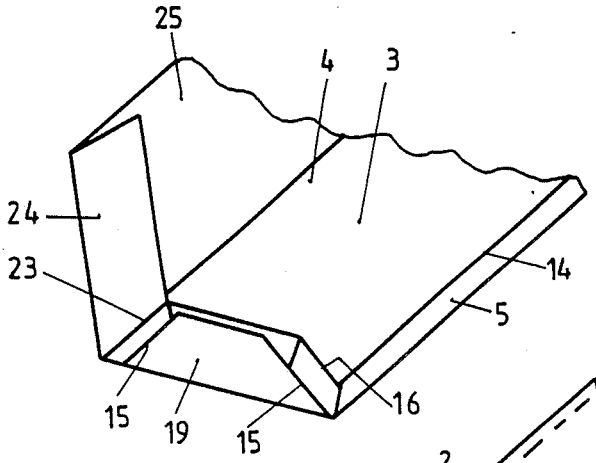
Figure 10:
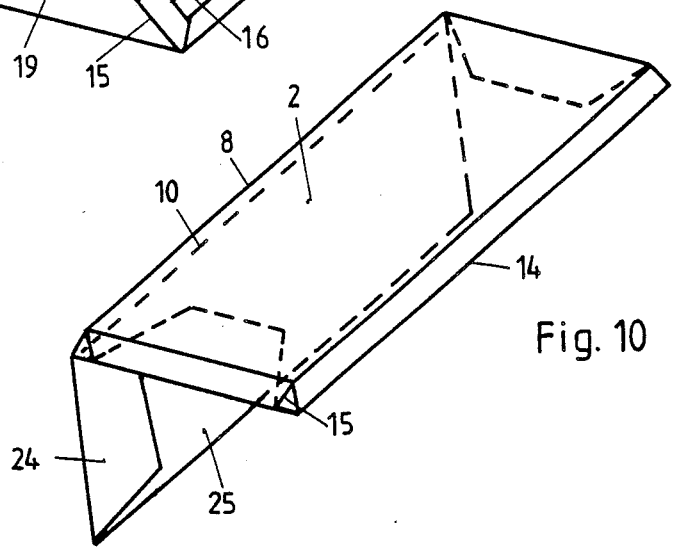
Figure 11:
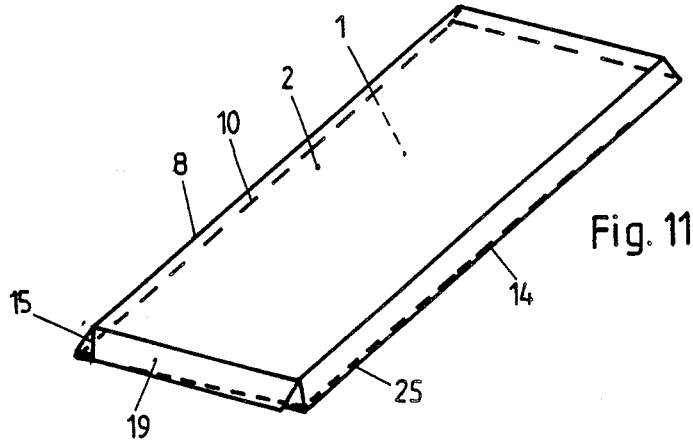

The method of manufacturing a wrapper will now be specified with reference to the drawing, wherein FIG. 1 is a perspective view illustrating the initial stage of the method, specifically the asymmetrical wrapping of the blank around the bar and the establishment of a longitudinal sealing seam, FIG. 2 is a front view of the areas illustrated in FIG. 1 with the bar illustrated in section, FIG. 3 is another perspective view once the projecting area of the blank has been wrapped against the lower surface of the bar, FIG. 4 is a front view of the areas illustrated in FIG. 3 with the bar illustrated in section, FIG. 5 illustrates an intermediate stage during which the bellows is being established, FIG. 6 shows a slightly advance stage of establishing the bellows, FIG. 7 illustrates how the areas of the bellows are folded down into the plane occupied by the lower surface of the bar and how the transverse seal is established, FIG. 8 illustrates how the projecting area of the blank is opened and how the areas of the bellows are folded down approximately half way, FIG. 9 is a perspective view of the various areas more or less in the same state represented by FIG. 8 but with the bar upside down, FIG. 10 illustrates the wrapper with the bellows folded down against the lower surface of the bar and with finished inner flaps on the projecting area of the blank before the facing is closed again, and FIG. 11 illustrates the finished wrapper with the facing completely closed.

Illustrated in FIGS. 1 and 2 is a chocolate bar 1 with an upper surface 2 and a lower surface 3, two sides 4 and 5, and two ends 6. A rectangular one-piece blank 7 has a coating of heat-sealing material on its inner surface, the surface that faces chocolate bar 1. Blank 7 is during an initial manufacturing stage wrapped asymmetrically around chocolate bar 1 as illustrated in FIGS. 1 and 2. The two margins of the blank project freely but to different extents beyond an upper longitudinal edge 8 of the bar that demarcates the upper surface 2 of the bar from side 4. The shorter margin of blank 7 rests against side 4 and the coated surface of its outer section 9, which is as wide as side 4 is high, faces up in such a way that the outer edge of that section will, as the packaging process continues as illustrated in FIGS. 3 and 4, arrive in the vicinity of a lower longitudinal edge 10 that demarcates side 4 from lower surface 3. Initially, however, a transverse seal 11 is established by longitudinal sealing in the vicinity of outer section 9 over all or part of the associated areas of blank 7 as indicated by the two arrows in FIG. 2. It is important that this longitudinal sealing seam 11 creates a tube 12 of wrapping material around chocolate bar 1 that even at this point will ensure the requisite tightness. The asymmetrically projecting end of blank 7 constitutes an area 13 that is wide enough to essentially cover the lower surface 3 of chocolate bar 1 once it has been folded around the bar along with a lower longitudinal edge 14 of the bar that demarcates lower surface 3 from side 5. Once longitudinal sealing seam 11 has been established, the area adjacent thereto is folded up against side 4 of the bar and area 13 of blank 7 is wrapped down around the bar and against lower surface 3, resulting in the state illustrated in FIGS. 3 and 4, at which area 13 has become integrated into tube 12 of wrapping material. As will be especially evident from FIG. 4, the tube is now reinforced where it contacts side 4 of the bar due to the several layers of material and to the rigidity of longitudinal sealing seam 11. This reinforcement relates to and only to the vicinity of side 4.

The reinforcement augments and facilitates the creation of a well-defined bellows at the end with prescribed and definitely situated creases 15 and 16. In a process that is illustrated in the beginning in FIG. 5 and complete in FIG. 6, areas 17 and 18 are folded in from the sides. Area 17 is that of the several layers of material and includes longitudinal sealing seam 11 in particular. Seam 11 is accordingly not a part of the area 13 of blank 7 (or of the facing that will be created later therefrom), which remains wrapped over the lower surface 3 of the bar. A trapezoidal gore 19 that results from the bellows-folding process and is situated more or less in the plane of the upper surface 2 of chocolate bar 1 (FIG. 6) is now folded down at a crease 20 (FIG. 7), subsequent to which all of the material in the projecting areas of blank 7 with the exception of the material covering the ends 6 of the bar is in the same plane as the lower surface 3 of the bar. At this stage a transverse sealing seam 21, represented by the double broken line, is established by a transverse seal at each end of the bar. The establishment of seam 21 involves pressure in the directions indicated by arrows 22, welding together the coating on the inside of the material. Since the coating over the area 13 of blank 7, which also extends over transverse sealing seam 21, is against the uncoated outside of blank 7, it does not participate in the seal. The transverse sealing seams also extend beyond the creases and in the final event ensure in conjunction with longitudinal sealing seam 11 that the bar is completely covered and sealed in. The process of creating the bellows creates a folded edge 23 in the vicinity of area 13 of the blank that slopes in and constitutes a transition between the parts of the bellows and an inner flap 24 created from the corners of the area 13 of blank 7 as illustrated in FIGS. 8 and 9. As will be evident by referring from FIG. 7 to FIG. 8, area 13 can be opened again by pivoting it up off the lower surface 3 of chocolate bar 1. This pivoting motion can proceed through an angle of 120°, simultaneously with which the parts of the bellows, including gore 19, can be positioned perpendicular to the upper and lower surfaces of the bar and against its ends 6. Folded edge 23 is accordingly folded in 180° by completely folding down the areas of the bellows parallel to the lower surface 3 of chocolate bar 1 as illustrated in FIG. 10. At this stage a facing 25 created from area 13 and inner flap 24 will already be slightly closed. As the motion continues, facing 25 is completely wrapped against the lower surface 3 of chocolate bar 1 and secured, by a gluing process for example that is for simplicity's sake not illustrated, to the areas of the bellows and of blank 7 situated at that location. Inner flaps 24 are folded at a slight angle to the extent that the wrapped-down areas of the bellows are covered by the flaps and by facing 25. The packaged bar will accordingly exhibit the classical envelope-type folding, with even the bottom completely covered due to the extensive area of facing 25.

We claim:

1. A method of manufacturing a wrapper for tabular products, particularly chocolate bars, comprising the steps: wrapping a one-piece rectangular-shaped blank asymmetrically around a bar to produce a facing and a tube-shaped member of wrapping material, forming a longitudinal sealing seam adjacent to one side of said bar and thereby forming an area of said blank projecting beyond said longitudinal sealing seam; wrapping said area against said lower surface of said bar and resting said area against said bar as part of said tube-shaped member; extending said tube-shaped member beyond the ends of said bar including said longitudinal forming bellows at said extended ends which encompass said longitudinal sealing seam as part of said tube-shaped member and forming inner flaps in said projecting area sealing seam; sealing tight said tube-shaped member at both said extended ends by a transverse seal extending over said projecting area and said bellows; opening said tube-shaped member after said sealing step by unfolding said projecting area from said lower surface and folding areas of said tube-shaped member that include said transverse seal and said bellows onto the lower surface of said bar; and refolding thereafter said projecting area back against said lower surface again in form of said facing to cover up areas of said bellows with said facing and securing said projecting area against a portion of said tubular-shaped member at said lower surface, said blank being free of cutouts, said facing being reopenable after said transverse seal.

2. A method as defined in claim 1, and folding said tube-shaped member with exception of said projecting area while said bellows is being formed, and positioning simultaneously areas of said tube-shaped member in a plane defined by said lower surface of said bar so that said transverse seal can be formed in said position.

3. A method as defined in claim 1, and wrapping around said inner flaps while folding transversely sealed areas of said tube-shaped member between said steps of opening said projecting area and refolding said facing.

4. A method as defined in claim 1, and folding a crease occurring when forming said bellows by 180° while unfolding said projecting area and refolding said facing for forming said inner flaps adjacent to said crease.

5. A method as defined in claim 3, and folding a crease occurring when forming said bellows 180° while unfolding said projecting area and refolding said facing for forming said inner flaps adjacent to said crease.

6. A method of manufacturing a wrapper for tabular products, particularly chocolate bars, comprising the steps: wrapping a one-piece rectangular-shaped blank asymmetrically around a bar to produce a facing and a tube-shaped member of wrapping material, forming a longitudinal sealing seam adjacent to one side of said bar and thereby forming an area of said blank projecting beyond said longitudinal sealing seam; wrapping said area against said lower surface of said bar and resting said area against said bar as part of said tube-shaped member; extending said tube-shaped member beyond the ends of said bar including said longitudinal forming bellows at said extended ends which encompass said longitudinal sealing seam as part of said tube-shaped member and forming inner flaps in said projecting area; sealing seam; sealing tight said tube-shaped member at both said extended ends by a transverse seal extending over said projecting area and said bellows; opening said tube-shaped member after said sealing step by unfolding said projecting area from said lower surface and folding areas of said tube-shaped member that include said transverse seal and said bellows onto the lower surface of said bar; and refolding thereafter said projecting area back against said lower surface again in form of said facing to cover up areas of said bellows with said facing and securing said projecting area against a portion of said tubular-shaped member at said lower surface, said blank being free of cutouts, said facing being reopenable after said transverse seal; folding said tube-shaped member with exception of said projecting area while said bellows is being formed, positioning simultaneously areas of said tube-shaped member in a plane defined by said lower surface of said bar so that said transverse seal can be formed in said position; wrapping around said inner flaps while folding transversely sealed areas of said tube-shaped member between said steps of unfolding said projecting area and refolding said facing; folding a crease occurring when forming said bellows by 180° while unfolding said projecting area and refolding said facing for forming said inner flaps against said crease.

* * * * *